US012459762B2

(12) United States Patent
Yamada

(10) Patent No.: US 12,459,762 B2
(45) Date of Patent: Nov. 4, 2025

(54) SHEET FEEDING DEVICE, IMAGE READING DEVICE AND IMAGE FORMING APPARATUS

(71) Applicant: CANON KABUSHIKI KAISHA, Tokyo (JP)

(72) Inventor: Kaname Yamada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 166 days.

(21) Appl. No.: 18/472,637

(22) Filed: Sep. 22, 2023

(65) Prior Publication Data

US 2024/0174468 A1 May 30, 2024

(30) Foreign Application Priority Data

Nov. 25, 2022 (JP) ..... 2022-188140

(51) Int. Cl.
*B65H 1/04* (2006.01)

(52) U.S. Cl.
CPC ..... *B65H 1/04* (2013.01); *B65H 2403/411* (2013.01); *B65H 2405/114* (2013.01); *B65H 2405/332* (2013.01); *B65H 2511/12* (2013.01); *B65H 2801/06* (2013.01)

(58) Field of Classification Search
CPC ..... B65H 1/04; B65H 2403/411; B65H 2405/114; B65H 2405/1144; B65H 2405/332; B65H 2511/12; B65H 2511/20; B65H 2511/22
See application file for complete search history.

(56) References Cited

U.S. PATENT DOCUMENTS

| | | | | |
|---|---|---|---|---|
| 9,156,637 | B2 * | 10/2015 | Asada | B41J 17/26 |
| 10,274,857 | B2 | 4/2019 | Yamada | |
| 10,597,244 | B2 | 3/2020 | Niwata | |
| 10,821,748 | B2 | 11/2020 | Mori | |
| 2007/0120316 | A1 * | 5/2007 | Shiohara | B65H 1/266 271/145 |
| 2007/0201923 | A1 * | 8/2007 | Asada | G03G 15/6502 399/405 |
| 2019/0030920 | A1 | 1/2019 | Mori | |
| 2019/0185281 | A1 | 6/2019 | Niwata | |
| 2024/0236249 | A1 * | 7/2024 | Urita | H04N 1/00559 |

FOREIGN PATENT DOCUMENTS

| | | | |
|---|---|---|---|
| JP | H02-064535 | A | 3/1990 |
| JP | 2007-251479 | A | 9/2007 |
| JP | 2017-128410 | A | 7/2017 |
| JP | 2019-025898 | A | 2/2019 |
| JP | 2019-108221 | A | 7/2019 |

* cited by examiner

*Primary Examiner* — Prasad V Gokhale
(74) *Attorney, Agent, or Firm* — Venable LLP

(57) ABSTRACT

A sheet feeding device includes a first supporter supporting a first sheet, a first regulator regulating a position of the first sheet supported by the first supporter in a widthwise direction, a second supporter and a second regulator. The second supporter is provided above the first supporter and support a second sheet, of which a length in the widthwise direction is shorter than that of the first sheet, in a state in which the first supporter supports the first sheet. The second regulator regulates a position of the second sheet in the widthwise direction. A feeder feeds the first sheet and the second sheet in a feeding direction. As viewed in the feeding direction, the second regulator is disposed so that at least a part of the second regulator is overlapped with the first regulator.

11 Claims, 15 Drawing Sheets

SHEET FEEDING DEVICE, IMAGE READING DEVICE AND IMAGE FORMING APPARATUS

FIELD OF THE INVENTION AND RELATED ART

The present invention relates to a sheet feeding device for feeding a sheet, an image reading device for reading image information from the sheet, and an image forming apparatus for forming an image on a recording material.

In Japanese Patent Application Laid-Open No. 2007-251479, a scanner device which is enabled to scan a small size document (original) such as a business card, a card, etc., which are difficult to be scanned with a main sheet feeding tray, by mounting an auxiliary sheet feeding tray to the main sheet feeding tray is disclosed. In Japanese Patent Application Laid-Open No. 2019-108221, a document conveying device which is capable of stacking multiple documents of different widths in parallel on a first document stand and a second document stand, which is provided above the first document stand and is narrower in width than the first document stand is disclosed.

However, in the configurations described in each of the above documents, since side ends of the small-sized document are guided by a guide portion fixed to the auxiliary sheet feeding tray or the second document stand, an oblique movement of the sheet may occur upon feeding the document having smaller width than that of the guide portion.

SUMMARY OF THE INVENTION

Therefore, an object of the present invention is to provide a sheet feeding device, an image reading device, and an image forming apparatus which can stack documents having different sizes in parallel and suppress an oblique movement of sheets.

According to an aspect of the present invention, a sheet feeding device comprising: a first supporting portion configured to support a sheet; a first regulating unit movably provided to the first supporting portion with respect to a sheet widthwise direction perpendicular to a sheet feeding direction and configured to regulate a position of the sheet, supported by the first supporting portion, with respect to the sheet widthwise direction; a second supporting portion provided above the first supporting portion and configured to be capable of supporting a sheet, of which a length in the sheet widthwise direction is shorter than that of the sheet supported by the first supporting portion, in a state in which the first supporting portion supports the sheet; a second regulating unit movably provided to the second supporting portion with respect to the sheet widthwise direction and configured to regulate a position of the sheet, supported by the second supporting portion, with respect to the sheet widthwise direction; and a feeding member configured to feed the sheet supported by the first supporting portion and the sheet supported by the second supporting portion with respect to the sheet feeding direction, wherein as viewed in the sheet feeding direction, the second regulating unit is disposed so that at least a part of the second regulating unit is overlapped with the first regulating unit.

Further features of the present invention will become apparent from the following description of exemplary embodiments with reference to the attached drawings.

DESCRIPTION OF THE EMBODIMENTS

In the following, embodiments of the present invention will be specifically described with reference to Figures.

Embodiment 1

Figure 1:
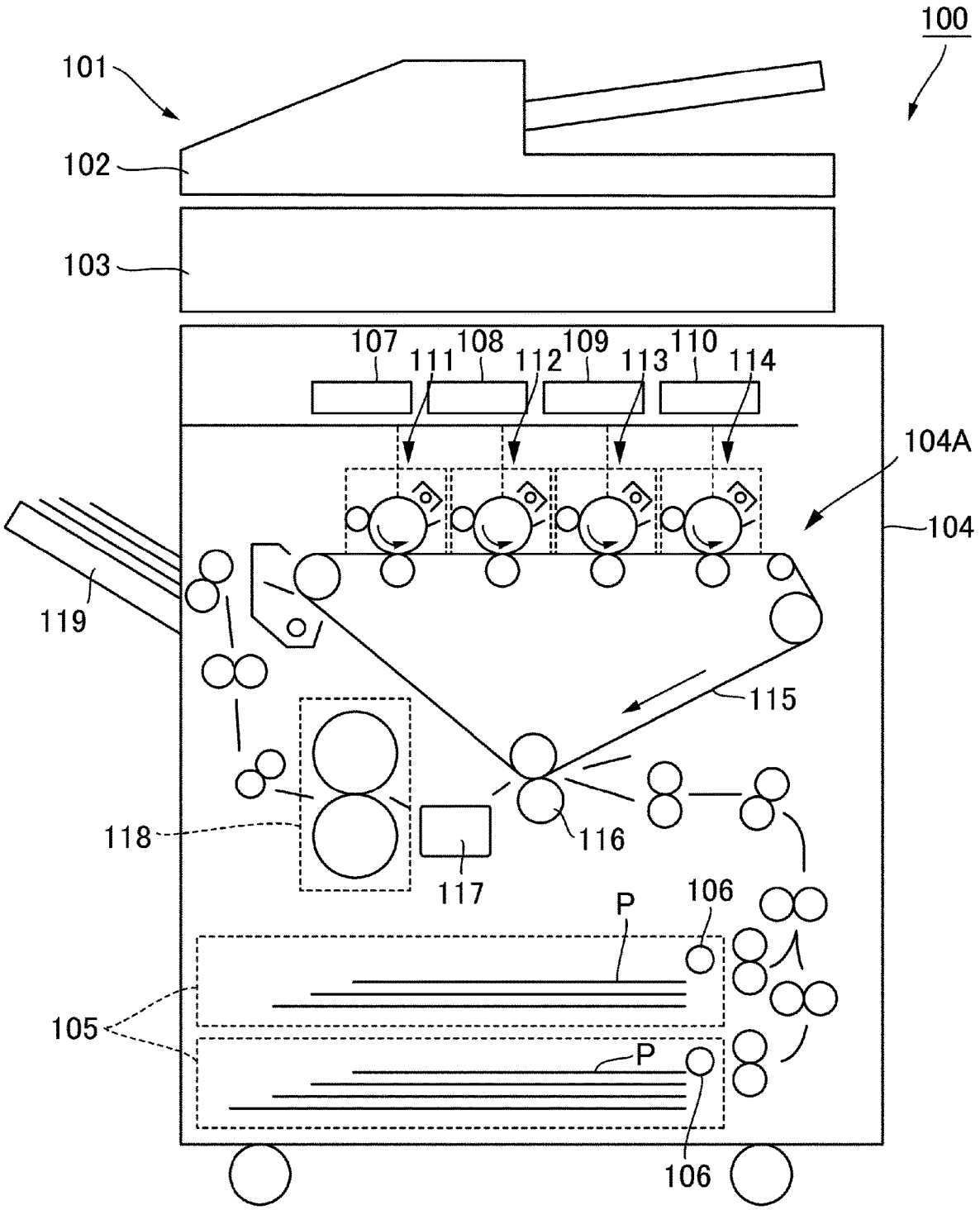
FIG. 1 is a schematic view of an image forming apparatus according to an Embodiment 1.

Configurations of a sheet feeding device, an image reading device, and an image forming apparatus according to an Embodiment 1 will be described. FIG. 1 is a schematic view illustrating an overall configuration of an image forming apparatus 100 according to the Embodiment 1. The image forming apparatus 100 includes an image forming apparatus main assembly (hereinafter referred to as a printer main assembly 104) and an image reading device 101 provided above the printer main assembly 104. The image forming apparatus 100 forms an image on a recording material P based on image data read by the image reading device 101 or image information received from a host device such as a personal computer communicably connected to the image forming apparatus 100. As the recording material (recording medium) P, a variety of sheet materials of different sizes and materials, for example, papers such as a plain paper and a thick paper, sheet materials with a surface treatment such as a coated paper, special shaped sheet materials such as an envelope and an index paper, a plastic film, a cloth, etc., may be used.

Inside the printer main assembly 104, as an example of an image forming unit, an image forming portion 104A of an electrophotographic method is accommodated. The image forming portion 104A includes four image forming units (process units) 111, 112, 113 and 114, four laser scanners 107, 108, 109 and 110 as exposure units, and an intermediary transfer belt 115 as an intermediary transfer member. The image forming portion 104A is an electrophotographic unit of a tandem type and of an intermediary transfer method, with the image forming units 111, 112, 113, and 114 being disposed side by side along the intermediary transfer belt 115.

Each of the image forming units 111, 112, 113 and 114 is provided with a photosensitive drum as an image bearing member and a charger, a developing unit, etc., which act on the photosensitive drum. The photosensitive drum is a photosensitive member formed in a cylindrical shape (drum-shaped). Inside the developing unit, developer (toner) is accommodated. The image forming units 111, 112, 113 and 114 are disposed along the intermediary transfer belt 115. The intermediary transfer belt 115 is an endless (belt-shaped) member stretched around a plurality of rollers. On an outer peripheral surface of the intermediary transfer belt 115, a secondary transfer roller 116 is in contact. A secondary transfer portion is formed as a nip portion between the intermediary transfer belt 115 and the secondary transfer roller 116.

In addition, the printer main assembly 104 is provided with at least one feeding cassette 105, a feeding roller 106 provided in each feeding cassette 105, a pre-fixing conveyance portion 117, a fixing device 118, and a discharge tray 119. The feeding cassette 105 is an example of a stacking portion (accommodating portion) in which the recording material P is stacked and accommodated. The feeding roller 106 is an example of a feeding member which feeds the recording material P. The pre-fixing conveyance portion 117 is a conveyance unit which conveys the recording material P from the secondary transfer portion to the fixing device 118. The fixing device 118 has a configuration of a thermal fixing method. For example, the fixing device 118 is provided with a roller pair which nips and conveys the recording material P, and a heating unit (heat source) such as a halogen lamp or induction heating mechanism to heat an image on the recording material P. The discharge tray 119 is a stacking portion in which the recording material P on which the image have been formed is stacked.

Upon an instruction for executing an image forming operation is given to the image forming apparatus 100, the photosensitive drum and the intermediary transfer belt 115 is driven and rotated in the image forming portion 104A. The charger charges a surface of the photosensitive drum. The laser scanners 107, 108, 109 and 110 irradiate the photosensitive drums in each of the image forming units 111, 112, 113 and 114 with laser beam (light) based on image signals, which are broken down from the image information into yellow, magenta, cyan and black components, to write an electrostatic latent image on the surface of the photosensitive drum. The electrostatic latent image is developed into a toner image by the toner supplied from the developing unit. The toner images formed on each photosensitive drum are primary transferred to the intermediary transfer belt 115. Upon the primary transfer, by the yellow, magenta, cyan and black toner images being transferred in multiple layers so that the toner images overlap each other, a full-color image is formed on the intermediary transfer belt 115.

Meanwhile, in parallel with the toner image formation in the image forming portion 104A, the recording material P is fed to the secondary transfer portion. The feeding roller 106 contacts an uppermost recording material P of a sheet bundle accommodated in the feeding cassette 105 and feeds the recording material P from the feeding cassette 105. The recording material P is conveyed via a plurality of conveyance roller pairs to the secondary transfer portion at a timing synchronized with the formation of the toner image in the image forming portion 104A. In the secondary transfer portion, the image is secondarily transferred from the intermediary transfer belt 115 to the recording material P.

The recording material P which has passed through the secondary transfer portion is conveyed to the fixing device 118 via the pre-fixing conveyance portion 117. The fixing device 118 heats and pressurizes the image on the recording material P to fix the image on the recording material P while conveying the recording material P. The recording material P which has passed through the fixing device 118 is discharged to an outside of the printer main assembly 104 by a discharging roller pair and stacked in the discharge tray 119.

Incidentally, in the above description, the image forming portion 104A, which is the electrophotographic unit of an intermediary transfer type, is disclosed as an example of the image forming unit, however, it is not limited to this configuration but, for example, an electrophotographic unit of a direct transfer type or an image forming unit of an inkjet method may be used as an image forming unit.

In addition, the image forming apparatus is not limited to what is integrally constituted by the image reading device 101 and the printer main assembly 104 as shown in FIG. 1 (copy machine, multifunction machine). The image forming apparatus may be a single-function printer equipped with only an image forming function (printer function). In addition, the image forming apparatus may be a small printer for home use (small multifunction machine) or a large printer for commercial use.

(Image Reading Device)

Image reading device 101 will be described. As shown in FIG. 1, the image reading device 101 is provided with a reader portion 103 fixed to an upper surface portion of the printer main assembly 104 and an automatic document feeder (Automatic Document Feeder, hereinafter referred to as ADF) 102, which is supported by the reader portion 103.

Figure 2:
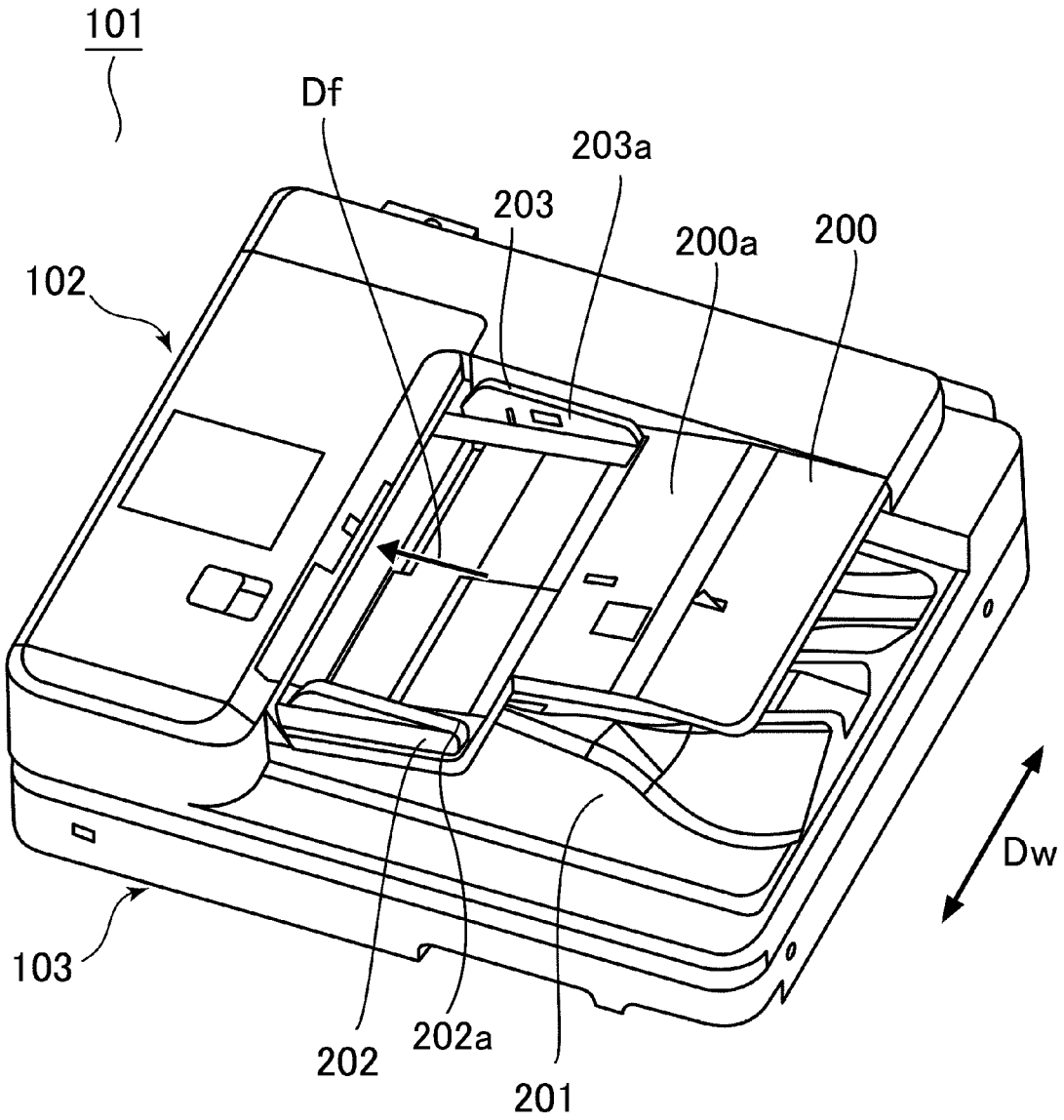
FIG. 2 is a perspective view of an image reading device according to the Embodiment 1.
Figure 3:
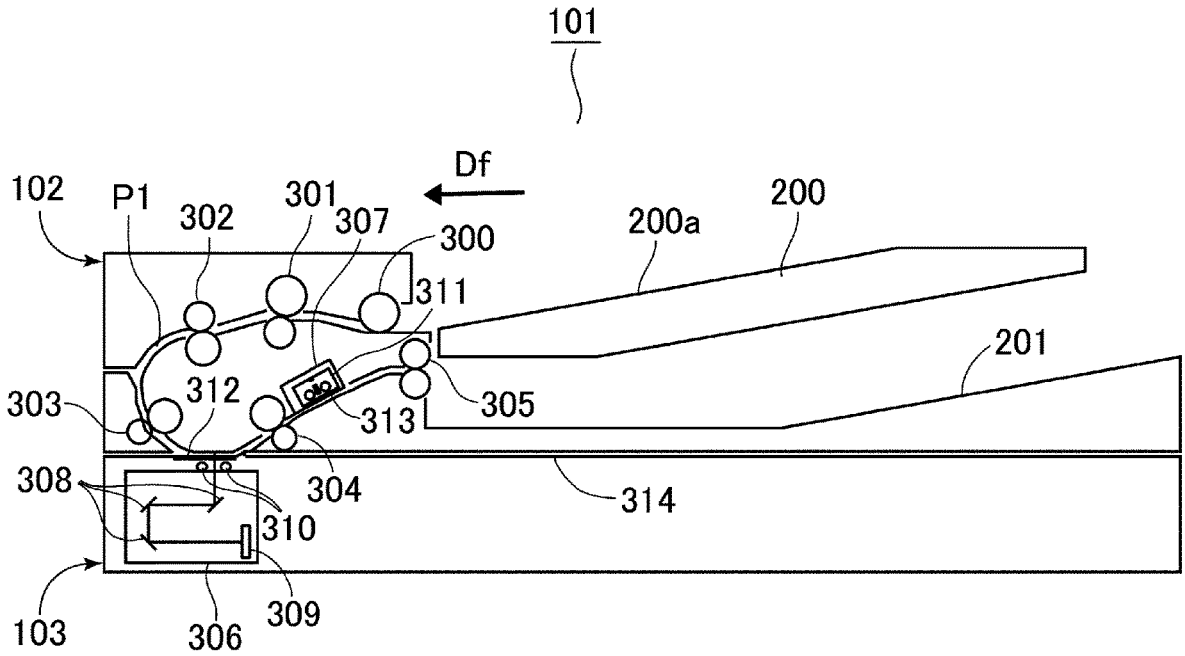
FIG. 3 is a schematic view of the image reading device according to the Embodiment 1.

FIG. 2 is a perspective view of the image reading device 101. FIG. 3 is a schematic view illustrating a cross-sectional configuration of the image reading device 101. Incidentally, FIG. 2 and FIG. 3 illustrate the image reading device 101 in a state without mounting a mixed stacking tray 400 described below.

In the following description and drawings, a direction in which the ADF 102 feeds a document from the document tray 200 or the mixed stacking tray 400 is defined as a sheet feeding direction Df. A direction which is along a surface of the sheet placed on the document tray 200 or mixed stacking tray 400 and is perpendicular to the sheet feeding direction Df is defined as a sheet widthwise direction Dw. In addition, a vertical direction (gravity direction) when the image forming apparatus 100 is installed on a horizontal plane is referred to as a vertical direction. Incidentally, in the present Embodiment, one side of the sheet widthwise direction Dw (lower left side of FIG. 2) is a near side (front side) of the image forming apparatus 100, and the other side of the sheet widthwise direction Dw (upper right side of FIG. 2) is a back side (rear side) of the image forming apparatus 100.

As shown in FIG. 2 and FIG. 3, the reader portion 103 is provided with a document table glass 314 on which the document is placed, a first reading unit 306 disposed below the document table glass 314, and a first feeding-reading glass 312. The document table glass 314 and the first feeding-reading glass 312 are both transparent members. The first reading unit 306 is capable of moving between a position opposed in the first feeding-reading glass 312 (position in FIG. 3) and a position opposed in the document table glass 314. In addition, the first reading unit 306 can move in a sub-scan direction (left-right direction in FIG. 3) below the document table glass 314.

The first reading unit 306 is an example of a reading portion (first reading portion) which reads an image on the sheet. The first reading unit 306 in the present Embodiment is an image sensor unit of a CCD method. That is, the first reading unit 306 is provided with a sensor substrate 309 on which a CCD image sensor as a light receiving element is mounted, a light source 310 which irradiates the document with light, and a plurality of mirrors 308 which guide reflected light from the document to an image forming surface of the light receiving element. The first reading unit 306 is configured to read image information through the first feeding-reading glass 312 or the document stand glass 314.

The ADF 102 is rotatably supported with respect to the reader portion 103 via a hinge mechanism provided on one side of the sheet widthwise direction Dw (rear side of the image forming apparatus 100). The ADF 102 is openable and closable between an open position, in which the document stand glass 314 exposes, and a closed position, in which the document stand glass 314 is covered.

As shown in FIG. 3, the ADF 102 is provided with a document tray 200, a discharge tray 201 disposed below the document tray 200, and a second reading unit 307. In addition, the ADF 102 is provided with a document conveyance path P1 which extends from the document tray 200 to the discharge tray 201, a feeding roller 300, a separating roller pair 301, conveyance roller pairs 302, 303 and 304, and a discharging roller pair 305 disposed along the document conveyance path P1. A portion where the document conveyance path P1 is formed (portion on the left side in FIG. 3 with respect to the document tray 200 and the discharge tray 201) is defined as a main-body portion of the ADF 102.

The ADF 102 is an example of a sheet feeding device which feeds the sheet. The ADF 102 in the present Embodiment feeds a document as the sheet. On an upper surface of the document tray 200, a first stacking portion 200*a* (supporting surface which supports the document) on which the document is stacked is provided. The first stacking portion 200*a* is an example of a supporting portion (first supporting portion) which supports the sheet. The discharge tray 201 is an example of a discharge portion (stacking portion) on which the sheets are discharged. The feeding roller 300 is an example of a feeding member which feeds the sheets supported by the document tray 200. The separating roller pair 301, the conveyance roller pairs 302, 303 and 304, and the discharging roller pair 305 are all examples of conveyance members which convey the sheets.

The document tray 200 is configured to be rotatable about an unshown rotary shaft with respect to the main-body portion of the ADF 102. A user can easily remove the document on the discharge tray 201 by rotating the document tray 200 toward above. In addition, to the document tray 200, the mixed stacking tray 400, which is described below, can be mounted. The document tray 200 may be configured to be rotatable with respect to the main-body portion of the ADF 102 also in a state in which the mixed stacking tray 400 is mounted.

The feeding roller 300 is configured to feed the document in the sheet feeding direction Df by rotating and being in contact with an upper surface of the document set on the document tray 200. Incidentally, as a feeding member, a belt member stretched around rotating rollers, for example, may be used.

The separating roller pair 301 is provided with a conveyance roller which feeds the document along the sheet feeding direction Df and a separating roller which is in contact with the conveyance roller. The separating roller allows only an uppermost document which is in contact with the conveyance roller to pass through a separating nip by exerting frictional force on the document in a direction opposite to the sheet feeding direction Df in the nip portion (separating nip) between the conveyance roller and the separating roller. The separating roller is configured, for example, to be supported by a shaft fixed to a frame member of the ADF 102 via a torque limiter. As the separating member for separating the sheets, instead of the separating roller described above, for example, a pad-shaped elastic member which is in contact with the feeding roller 300 may be used.

As shown in FIG. 2, the document tray 200 is provided with a near side regulating plate 202 and a back side regulating plate 203. The near side regulating plate 202 and the back side regulating plate 203 are examples of a first regulating unit which regulates a position of the sheet supported by the document tray 200 in the sheet widthwise direction Dw.

The near side regulating plate 202 and the back side regulating plate 203 are a pair of regulating members (pair of first regulating members) opposed in the sheet widthwise direction Dw. Each of the near side regulating plate 202 and the back side regulating plate 203 is provided with a regulating surface 202*a* and a regulating surface 203*a* (contacting surfaces which are in contact with side ends of the sheet) which are protruded above with respect to the first stacking portion 200*a* of the document tray 200 and extend along the sheet feeding direction Df.

Each of the near side regulating plate 202 and the back side regulating plate 203 is capable of moving with respect to the document tray 200 in the sheet widthwise direction Dw. In addition, the near side regulating plate 202 and the back side regulating plate 203 are configured to move in interrelation with each other in opposite directions with respect to the sheet widthwise direction Dw with respect to a conveyance reference Rf as a center. In other words, the near side regulating plate 202 and the back side regulating plate 203 move as one of the regulating plates moves in interrelation with a movement of the other regulating plate so that the regulating surface 202*a* and the regulating surface 203*a* maintain a symmetrical positional relationship with respect to the conveyance reference Rf as a symmetrical axis. In a case in which the user sets the document in the document tray 200, after placing the document on the first stacking portion 200*a*, the user may grasp and move the near side regulating plate 202 or the back side regulating plate 203 in the sheet widthwise direction Dw so that the regulating surface 202*a* and the regulating surface 203*a* are in contact with the side ends of the document.

As an interrelating mechanism for regulating the near side regulating plate 202 and the back side regulating plate 203, a rack-and-pinion mechanism may be used. The rack-and-pinion mechanism is constituted by a first rack provided to the near side regulation plate 202, a second rack provided to the back side regulation plate 203, and a pinion gear which engages with each of the first rack and the second rack.

Incidentally, the conveyance reference Rf mentioned above is a reference position with respect to the sheet widthwise direction Dw of the document fed by the feeding roller 300. In the present Embodiment, positions of the documents stacked on the document tray 200 are regulated by the near side regulating plate 202 and the back side regulating plate 203, which are in the symmetrical position with respect to the conveyance reference Rf, so that centers of the documents in the sheet widthwise direction Dw are aligned with the conveyance reference Rf. In addition, it is preferable that outer peripheral portions (contact portions to the document) of each of the feeding roller 300 and other conveyance roller pairs (301, 302, 303, 304 and 305) be disposed symmetrically with respect to the conveyance reference Rf in the sheet widthwise direction Dw.

Incidentally, in a case, for example, in which it is predetermined in advance that only one size of the document is to be stacked on the document tray 200, members which correspond to the near side regulating plate 202 and the back side regulating plate 203 (first regulating unit) may be configured to be fixed to the document tray 200.

The second reading unit 307 is an example of the reading portion (a second reading portion) which reads the image on the sheet. The second reading unit 307 of the present Embodiment includes an image sensor of contact type (Contact Image Sensor, hereinafter referred to as a CIS 311). The CIS 311 includes a sensor substrate on which light receiving elements are arranged along the sheet widthwise direction Dw, a light source which illuminates the document, and a lens array which guides reflected light from the document to image forming surfaces of the light receiving elements. In addition, in the second reading unit 307, a second feeding-reading glass 313, which is a transparent member, is disposed. The CIS 311 is configured to read image information from the document conveyed in the document conveyance path P1 via the second feeding-reading glass 313.

Incidentally, the configurations of the first reading unit 306 and the second reading unit 307 described above are examples of reading portions (first reading portion and second reading portion), and as the first reading unit 306, for example, an image sensor unit of CIS method may be used.

The image reading device 101 is capable of executing an operation of reading the image information from a stationary document placed on the document table glass 314 (fixed reading) and an operation of reading the image information while feeding the sheet as the document by the ADF 102 (feeding-reading).

Hereinafter, with reference to FIG. 3, a reading operation of the image reading device 101 will be described. Incidentally, an operation of the image reading device 101 in a state in which the mixed stacking tray 400 is mounted will be described later.

In a case of the fixed reading, the user opens the ADF 102, places the document on the document table glass 314, closes the ADF 102, and then instructs a start of the reading operation by operating an operating portion of the image forming apparatus 100. Then, the first reading unit 306 reads the image information of the document by optically scanning a surface of the document through the document table glass 314 while moving in the sub-scan direction below the document table glass 314.

In a case of the feeding-reading, the user places the documents on the document tray 200, moves the near side regulating plate 202 or the back side regulating plate 203 according to a size of the documents, and then instructs a start of the reading operation by operating the operating portion of the image forming apparatus 100. Then, the feeding roller 300 of the ADF 102 starts rotating and feeds the documents set in the document tray 200 in the sheet feeding direction Df, in order from the uppermost document.

The document which started to be fed by the feeding roller 300 is conveyed in the main body of the ADF 102 along the document conveyance path P1. First, the documents fed from the document tray 200 by the feeding roller 300 are separated one by one by the separating roller pair 301. Next, the document is conveyed while being passed over in order by the conveyance roller pairs 302, 303 and 304. When the document passes through the first feeding-reading glass 312 of the reader portion 103, the image information on a first surface (front surface) of the document is read by the first reading unit 306. In addition, when the document passes through the second reading glass 313, the second reading unit 307 reads the image information on a second surface (back surface) of the document, which is opposite to the first surface. The document whose image information has been read is discharged outside of the ADF 102 by the discharging roller pair 305 and stacked on the discharge tray 201.

(Mixed Stacking Tray)

The mixed stacking tray 400 with which the ADF 102 of the present Embodiment is provided will be described using FIG. 4 through FIG. 11. The mixed stacking tray 400 is a member (auxiliary tray, sub-tray) which allows documents having different sizes from those stacked in the document tray 200 (main tray) to be stacked.

Figure 4:
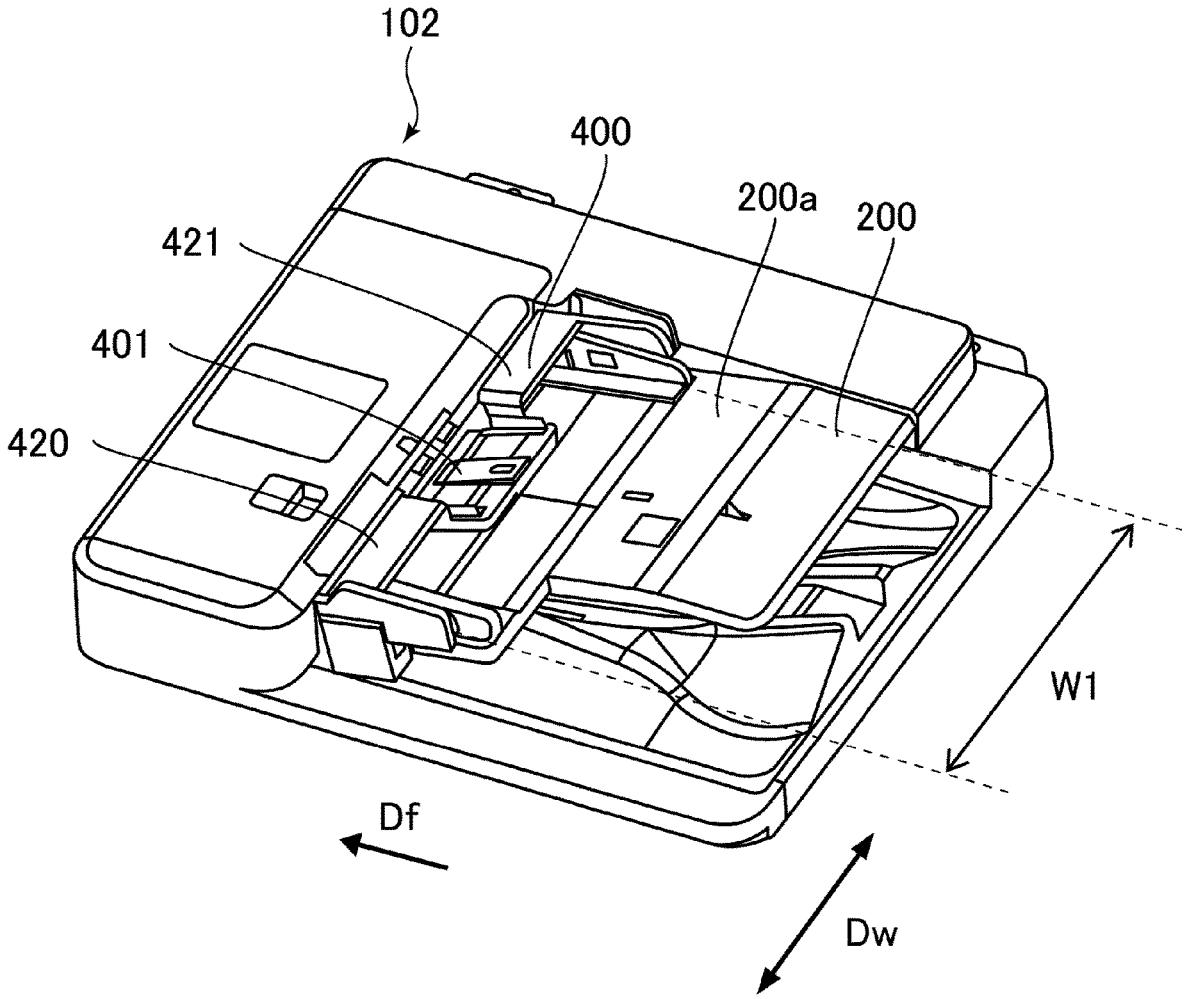
FIG. 4 is a perspective view of an ADF (Automatic Document Feeder) according to the Embodiment 1.
Figure 5:
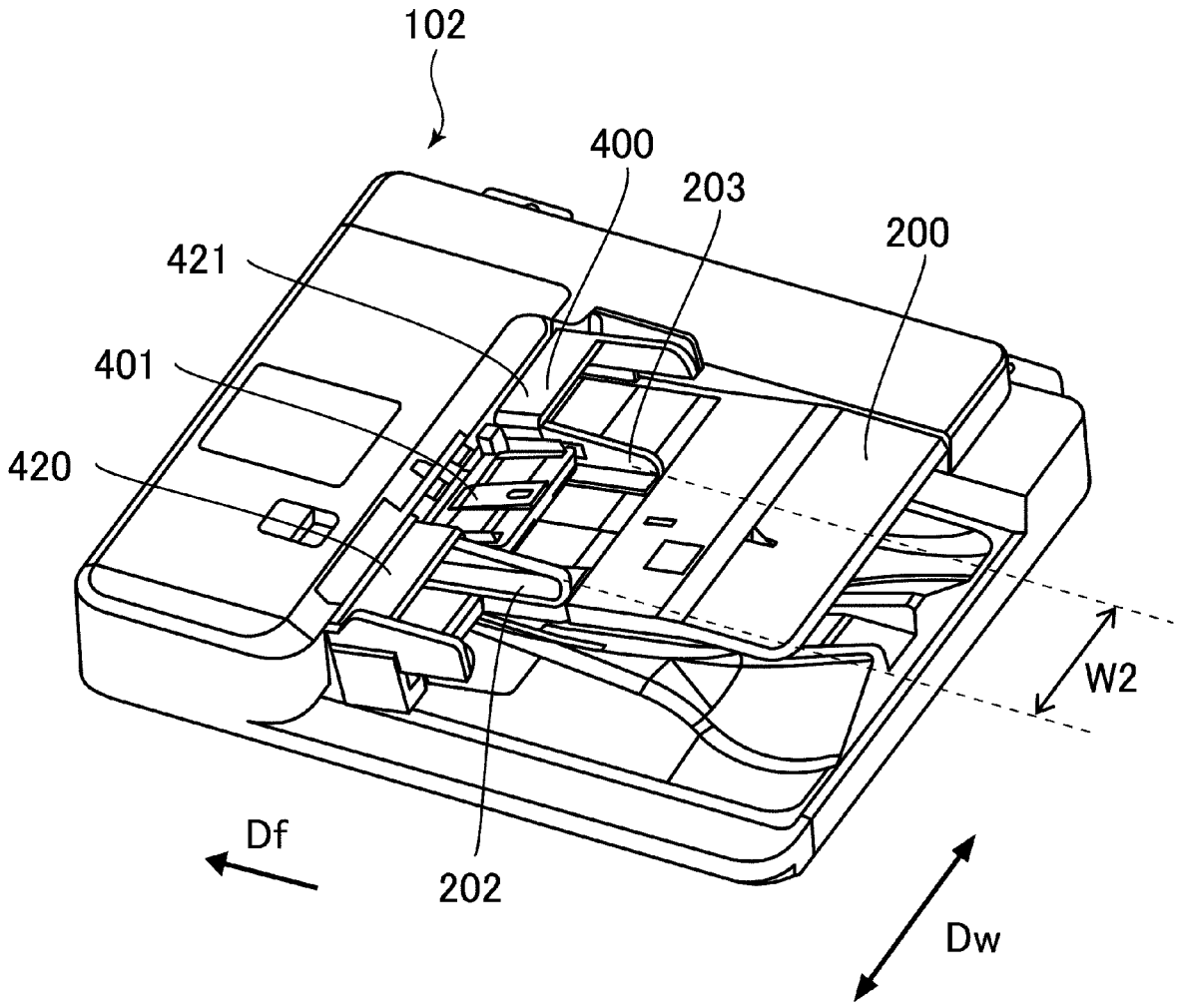
FIG. 5 is a perspective view of the ADF according to the Embodiment 1.
Figure 6:
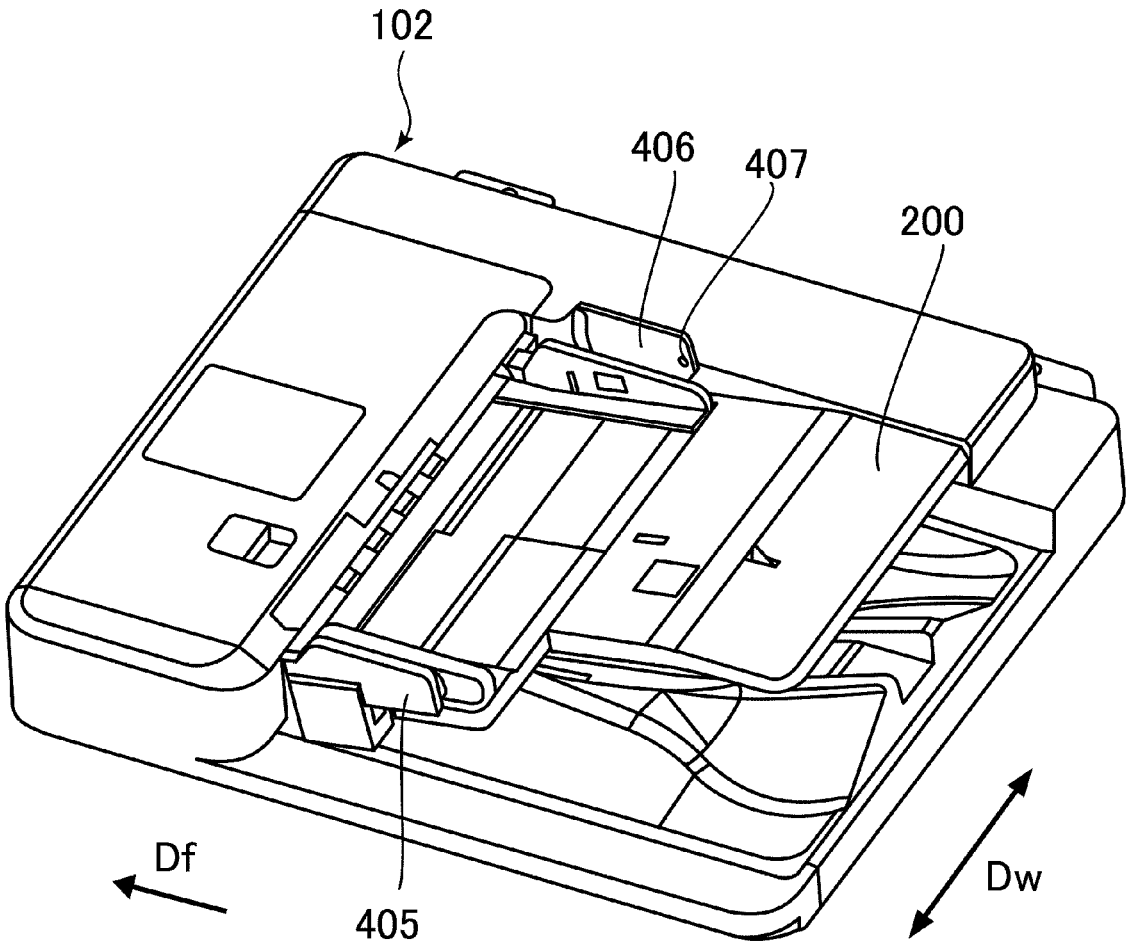
FIG. 6 is a perspective view of the ADF according to the Embodiment 1.
Figure 7:
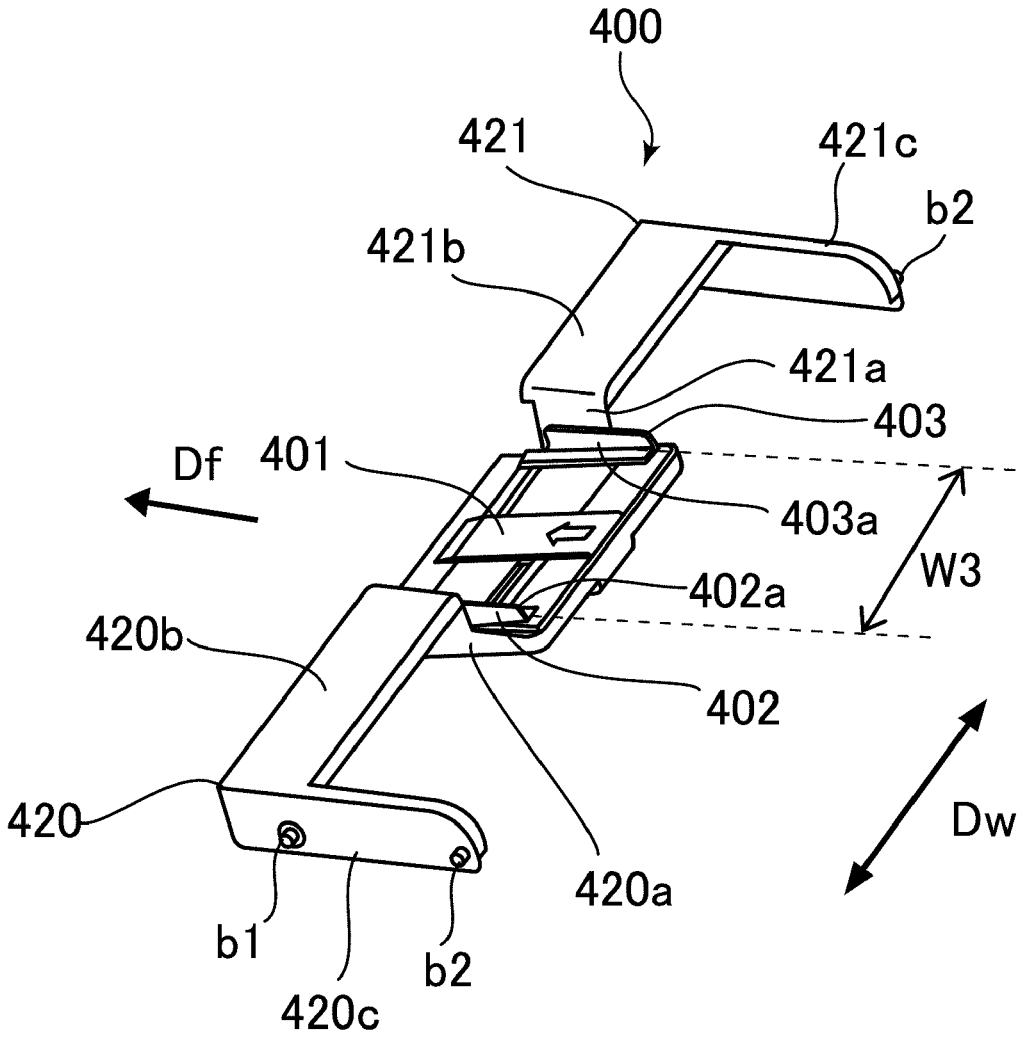
FIG. 7 is a perspective view of a mixed stacking tray according to the Embodiment 1.
Figure 8:
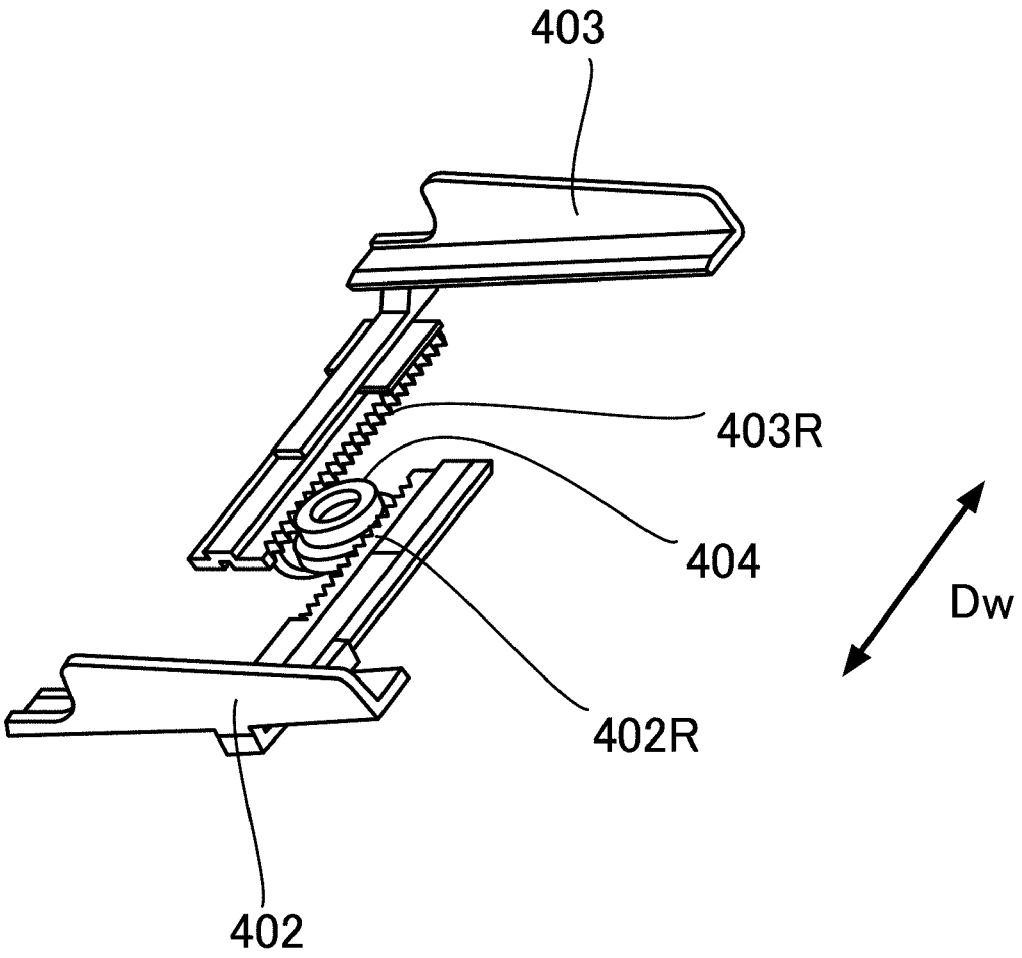
FIG. 8 is a view illustrating a part of the mixed stacking tray according to the Embodiment 1.
Figure 9:
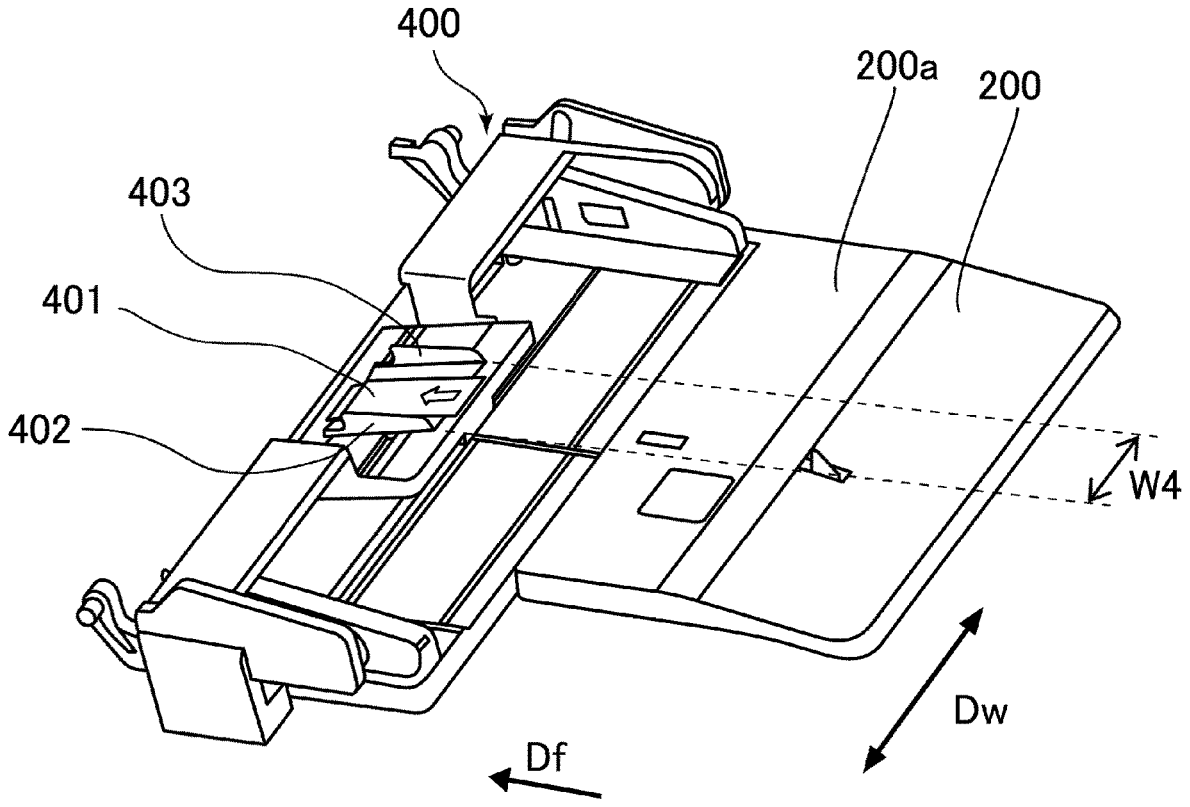
FIG. 9 is a perspective view of a document tray and the mixed stacking tray according to the Embodiment 1.
Figure 10:
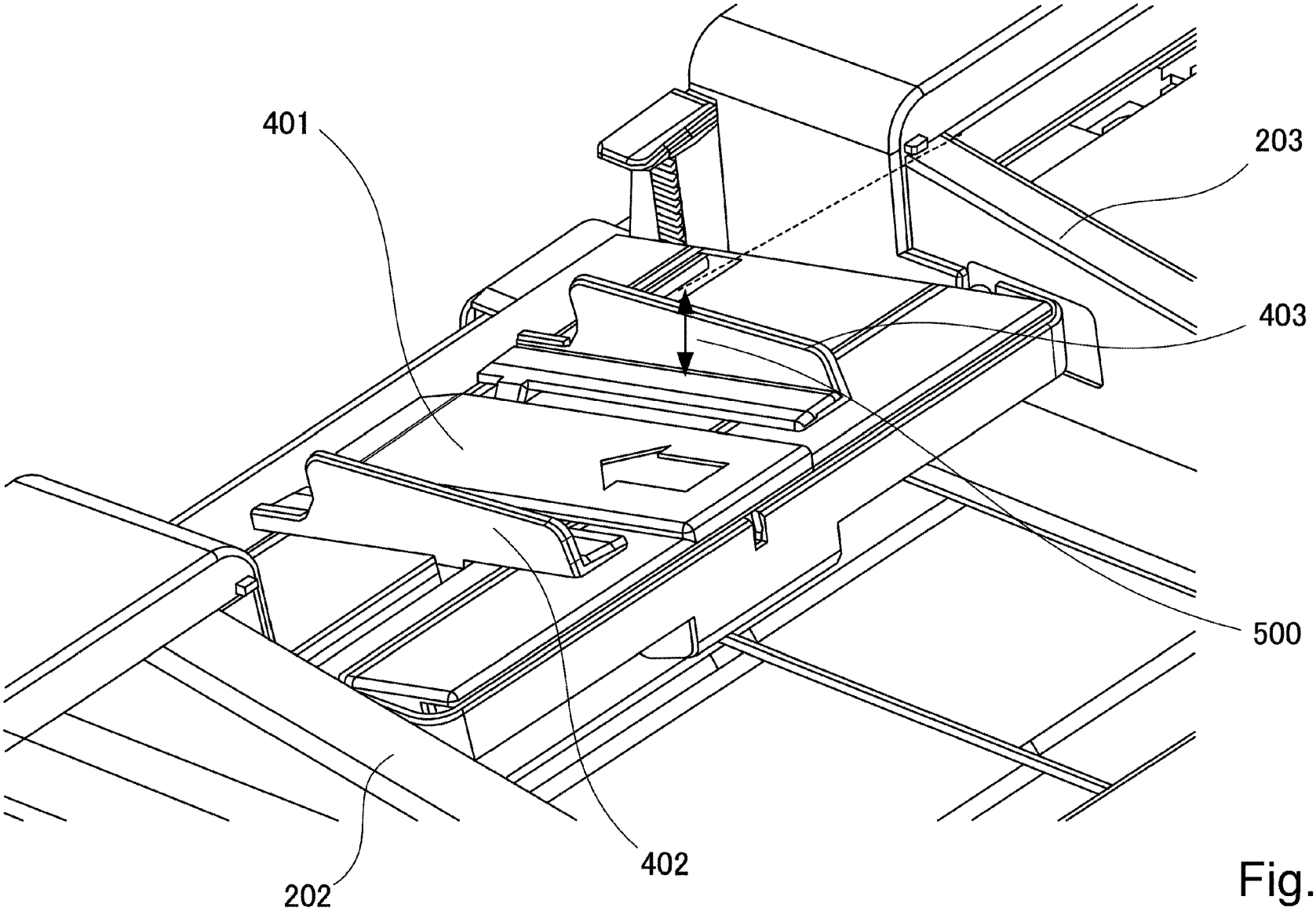
FIG. 10 is a perspective view illustrating a part of the document tray and the mixed stacking tray according to the Embodiment 1.
Figure 11:
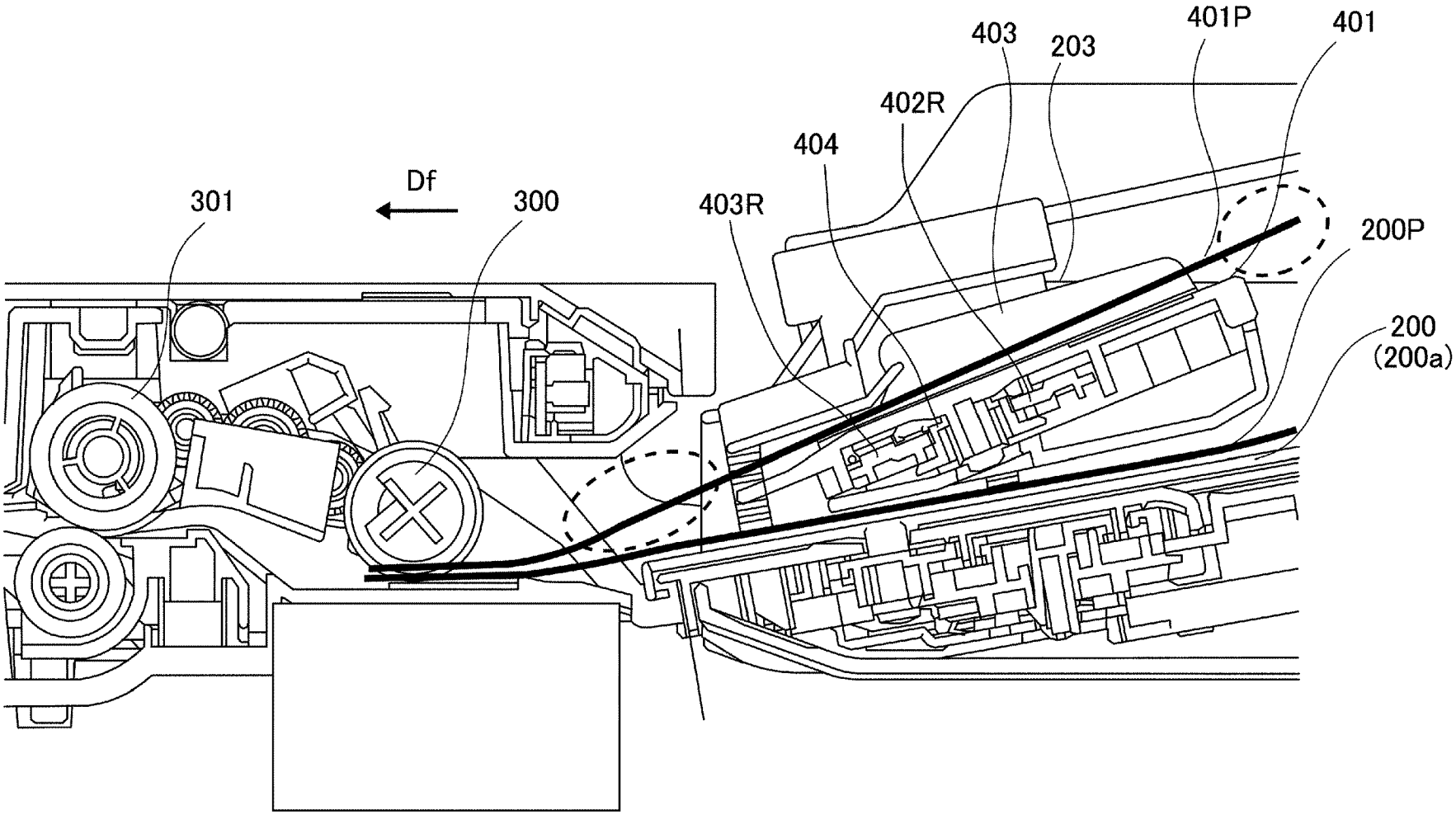
FIG. 11 is a cross-sectional view of the ADF according to the Embodiment 1.

FIG. 4 is a perspective view illustrating the ADF 102 in a state in which the mixed stacking tray 400 is mounted. FIG. 5 is a perspective view illustrating a state in which the near side regulating plate 202 and the back side regulating plate 203 of the document tray 200 are moved inside the sheet widthwise direction Dw from the state of FIG. 4. FIG. 6 is a perspective view illustrating the ADF 102 in a state in which a mounting member 405 and a mounting member 406 are mounted. FIG. 7 is a perspective view illustrating the mixed stacking tray 400 in a state in which the mixed stacking tray 400 is not mounted to the ADF 102. FIG. 8 is a perspective view illustrating an interrelating mechanism (rack-and-pinion mechanism) with which the mixed-stacking tray 400 is provided. FIG. 9 is a perspective view illustrating a state in which the near side regulating plate 402 and the back side regulating plate 403 of the mixed stacking tray 400 are moved inside the sheet widthwise direction Dw from the state shown in FIG. 4. FIG. 10 is a perspective view to describe a positional relationship between the near side regulating plate 402 and the back side regulating plate 403 of the mixed stacking tray 400 and the near side regulating plate 202 and the back side regulating plate 203 of the document tray 200. FIG. 11 is a cross-sectional view of the ADF 102 in a state in which the documents are placed on both the document tray 200 and the mixed stacking tray 400.

As shown in FIG. 4 and FIG. 11, according to the ADF 102 of the present Embodiment, the documents can be set on both the document tray 200 and the mixed stacking tray 400 in the state in which the mixed stacking tray 400 is mounted to the ADF 102. In other words, the ADF 102 can feed the documents on the document tray 200 and the document on the mixed stacking tray 400 consecutively in the state in which the documents are stacked on both the document tray 200 and the mixed stacking tray 400. In this case, first, the feeding roller 300 is in contact with an upper surface of the document (bundle) stacked on the mixed stacking tray 400, and feeds the documents in order from the uppermost document. When there is no document stacked on the mixed stacking tray 400, the feeding roller 300 is then in contact with the upper surface of the document (bundle) stacked on the document tray 200 and feeds the documents in order from the uppermost document.

Thus, the ADF 102 can feed documents having different sizes set in parallel on both the document tray 200 and the mixed stacking tray 400 consecutively as one series of operational sequences. In addition, the image reading device 101 provided with the ADF 102 can execute an operation (mixed-stacking job) to read image information from documents having different sizes set in parallel on both the document tray 200 and the mixed stacking tray 400 based on a single start instruction of the reading operation.

As shown in FIGS. 4 and 7, the mixed stacking tray 400 is provided with a stacking portion on which the documents are stacked (hereinafter referred to as the second stacking portion 401), an arm portion 420, an arm portion 421, a near side regulating plate 402, and a back side regulating plate 403.

The second stacking portion 401 is positioned above the first stacking portion 200*a* of the document tray 200 in the state in which the mixed stacking tray 400 is mounted to the ADF 102. Preferably, the second stacking portion 401 is overlapped with the first stacking portion 200*a* as viewed from above. Provided, what two members are "overlapped" as viewed in a particular direction means that when each member is vertically projected onto a virtual plane perpendicular to the particular direction, a projected area of one member is at least partially overlapped with a projected area of the other member.

On the second stacking portion 401, the documents whose length in the sheet widthwise direction Dw is shorter than that of the documents stacked on the document tray 200 may be stacked. In other words, a width of the second stacking portion 401 in the sheet widthwise direction Dw is shorter than a width of the first stacking portion 200*a* in the sheet widthwise direction Dw. The second stacking portion 401 is an example of a second supporting portion, which is provided above the first supporting portion and supports a sheet whose length in the sheet widthwise direction is shorter than that of the sheet supported by the first supporting portion.

The arm portion 420 and the arm portion 421 extend from the second stacking portion 401 toward both sides with respect to the sheet widthwise direction Dw. The arm portion 420 is connected to an end portion of a near side of the second stacking portion 401, and the arm portion 421 is connected to an end portion of the back side of the second stacking portion 401.

Each of the arm portion 420 and the arm portion 421 includes a first portion 420*a* and a first portion 421*a*, which rise toward above side from the end portion of the near side or the end portion of the back side of the second stacking portion 401, and a second portion 420*b* and a second portion 421*b*, which extend toward outsides with respect to the sheet widthwise direction Dw from an upper end of the first portion 420*a* and an upper end of the first portion 421*a*. In addition, each of the arm portion 420 and the arm portion 421 includes a third portion 420*c* and a third portion 421*c*, which extend toward below from each end portion of an outside of the second portion 420*b* and the second portion 421*b* with respect to the sheet widthwise direction Dw. In other words, each of the arm portion 420 and the arm portion 421 in the present Embodiment includes a form of U-shape which opens toward below as viewed in the sheet feeding direction Df.

The second stacking portion 401 is fixed to the arm portion 420 and the arm portion 421 in a state in which the second stacking portion 401 is sandwiched between the first portion 420*a* and the first portion 421*a* from both sides in the sheet widthwise direction Dw. The arm portion 420, the arm portion 421 and the second stacking portion 401 may be configured as plastic components which is integrally molded.

The mixed stacking tray 400 of the present Embodiment is constituted so that the second stacking portion 401 is held away above (hung in the air) from the first stacking portion 200*a* of the document tray 200 by the arm portion 420 and the arm portion 421 which have the above shape. By this, the documents may be set on the document tray 200 even in the state in which the mixed stacking tray 400 is mounted.

The arm portion 420 and the arm portion 421 are examples of a holding unit supported by the first supporting portion and configured to hold the second supporting portion at an upper position of the first supporting portion. As the holding unit, instead of the arm portion 420 and the arm portion 421, it may be configured, for example, so that a hook shape provided in an end portion of the second stacking portion 401 with respect to the sheet feeding direction Df engages with a hole portion provided in the main-body portion of the ADF 102.

As shown in FIG. 4 and FIG. 5, even in the state in which the mixed stacking tray 400 is mounted, the near side regulating plate 202 and the back side regulating plate 203 of the document tray 200 can be moved. The near side regulating plate 202 and the back side regulating plate 203 of the present Embodiment is capable of moving toward an inside in the sheet widthwise direction Dw to a position abutting to the first portion 420*a* of the arm portion 420 and the first portion 421*a* of the arm portion 421. Incidentally, in the state in which the mixed stacking tray 400 is mounted, the near side regulating plate 202 and the back side regulating plate 203 may be configured to enter a downside of the second stacking portion 401 and to be able to move more inside the sheet widthwise direction Dw than the first portion 420*a* of the arm portion 420 and the first portion 421*a* of the arm portion 421.

The near side regulating plate 202 and the back side regulating plate 203 of the document tray 200 can move in the sheet widthwise direction Dw even in the state in which the mixed stacking tray 400 is mounted by utilizing space below the arm portion 420 and the arm portion 421. Specifically, the near side regulating plate 202 of the present Embodiment moves with respect to the sheet widthwise direction Dw below the second portion 420*b* of the arm portion 420 formed in the U-shape and in a space between the first portion 420*a* and the third portion 420*c* with respect to the sheet widthwise direction Dw. The back side regulating plate 203 moves with respect to the sheet widthwise direction Dw below the second portion 421*b* of the arm portion 421 formed in the U-shape and in a space between the first portion 421*a* and the third portion 421*c* with respect to the sheet widthwise direction Dw.

Incidentally, as viewed in the sheet widthwise direction Dw, the near side regulating plate 202 and the back side regulating plate 203 are overlapped with the first portion 420*a* and the first portion 421*a*, and with the third portion 420*c* and the third portion 421*c* of the arm 420 and the arm 421, but not with the second portion 420*b* and the second portion 421*b*.

A maximum width of the document which can be set on the first stacking portion 200*a* of the document tray 200 is defined as W1 (FIG. 4). A minimum width of the document which can be regulated by the near side regulating plate 202 and the back side regulating plate 203 of the document tray 200 in the state in which the mixed stacking tray 400 is mounted is defined as W2 (FIG. 5). A maximum width of the document which can be set on the second stacking portion 401 of the mixed stacking tray 400 is defined as W3 (FIG. 7). A minimum width of the document which can be regulated by the near side regulating plate 402 and the back side regulating plate 403 of the mixed stacking tray 400 is defined as W4 (FIG. 9).

In the present Embodiment, a relationship is to be W1>W2>W3>W4. In the state in which the mixed stacking tray 400 is mounted, a gap is created between the minimum width W2 of the document which can be set in the document tray 200 and the maximum width W3 of the document which can be set on the mixed stacking tray 400. However, a size of the second stacking portion 401 of the mixed stacking tray 400 may be changed as needed according to a size of an assumed document. In addition, it may be possible to prepare multiple types of the mixed stacking tray 400 having different sizes of the second stacking portion 401 and to mount a type of the mixed stacking tray which is appropriate for a use case.

As shown in FIG. 6, a mounting member 405 and a mounting member 406 may be attached on both end portions of the document tray 200 with respect to the sheet widthwise direction Dw. As shown in FIG. 7, a boss b1 and a boss b2, which are held by the mounting member 405 and the mounting member 405, respectively, are disposed on the third portion 420*c* of the arm portion 420 and the third portion 421*c* of the arm portion 421 of the mixed stacking tray 400. By fitting the boss b1 and the boss b2 into hole portions 407 (only one of which is illustrated in FIG. 6) provided in the mounting member 405 and the mounting member 406, respectively, it becomes possible for the mixed stacking tray 400 to be mounted so as to be mountable to and demountable from the ADF 102. The boss b1 and the boss b2 are examples of an engaging portion configured to hold the second supporting portion via the arm portion by engaging with an engaged portion fixed to the first supporting portion, and the hole portions 407 are examples of the engaged portion.

Incidentally, as a method to make the mounting member 405 and the mounting member 406 hold the mixed stacking tray 400, it is not limited to the fitting of the bosses and hole portions, but may be, for example, a screw-fastening or a snap-fitting. In addition, it may be configured that, for example, the mixed stacking tray 400 is mounted without the mounting member 405 and the mounting member 406 by providing the hole portions 407 to members which are integral with the document tray 200.

As shown in FIG. 7, the near side regulating plate 402 and the back side regulating plate 403 are a pair of regulating members (a pair of second regulating members) opposed in the sheet widthwise direction Dw. Each of the near side regulating plate 402 and the back side regulating plate 403 is provided with a regulating surface 402*a* and a regulating surface 403*a* (contacting surfaces which contact the side edges of the sheet) which are protruded above with respect to the second stacking portion 401 of the mixed stacking tray 400 and extend along the sheet feeding direction Df.

Each of the near side regulating plate 402 and the back side regulating plate 403 is capable of moving in the sheet widthwise direction Dw with respect to the second stacking portion 401. In addition, the near side regulating plate 402 and the back side regulating plate 403 are configured to move in interrelation with each other via an interrelating mechanism. Specifically, when one of the near side regulating plate 402 and the back side regulating plate 403 is moved, the other regulating plate is also moved so that the regulating surface 402*a* and the regulating surface 403*a* maintain a symmetrical positional relationship across the conveyance reference Rf (with the conveyance reference Rf as a symmetrical axis) in the sheet widthwise direction Dw.

FIG. 8 is a perspective view illustrating a rack-and-pinion mechanism as an example of the interrelating mechanism. The rack-and-pinion mechanism includes rack portions (a first rack 402R, a second rack 403R) provided to the near side regulating plate 402 and the back side regulating plate 403, respectively, and a pinion gear 404 which engages with each of the first rack 402R and the second rack 403R. The rack and pinion mechanism is accommodated inside the second stacking portion 401 (FIG. 11).

When one of the near side regulating plate 402 and the back side regulating plate 403 is moved in the sheet widthwise direction Dw, the first rack 402R and the second rack 403R move in opposite directions to each other via the engagement with the pinion gear 404. As a result, the near side regulating plate 402 and the back side regulating plate 403 always move in interrelation with each other with respect to the sheet widthwise direction Dw. As shown in FIG. 7 and FIG. 9, the near side regulating plate 402 and the back side regulating plate 403 of the mixed stacking tray 400 are capable of moving so that a distance between the regulating surface 402*a* and the regulating surface 403*a* varies from the maximum width W3 to the minimum width W4. When the user sets a document in the mixed stacking tray 400, the user can grasp and move the near side regulating plate 402 or the back side regulating plate 403 in the sheet widthwise direction Dw after placing the document on the second stacking portion 401 to make the regulating surface 402*a* and the regulating surface 403*a* be in contact with side ends of the document.

Incidentally, the rack-and-pinion mechanism described above is an example of the interrelating mechanism to make the near side regulating plate 402 and the back side regulating plate 403 be interrelated, and other mechanisms may be used. For example, an interrelating mechanism in which the near side regulation plate 402 is connected to one end of a lever which pivots about a central axis on the conveyance reference Rf and the back side regulation plate 403 is connected to the other end of the lever may be used. In addition, an interrelating mechanism in which, by fixing each of the near side regulating plate 402 and the back side regulating plate 403 to a belt member stretched in the sheet widthwise direction Dw, a rotation of the belt member causes the near side regulating plate 402 and the back side regulating plate 403 to move in opposite directions to each other may be used.

As shown in FIG. 10, it is preferable that, in a document stacking direction, positions of the near side regulating plate 402 and the back side regulating plate 403 of the mixed stacking tray 400 and positions of the near side regulating plate 202 and the back side regulating plate 203 of the document tray 200 be overlapped in a part of a range 500. The document stacking direction is a direction perpendicular to an upper surface of the second stacking portion 401. In addition, it is preferable that, as viewed in the sheet widthwise direction Dw, the near side regulating plate 202 and the back side regulating plate 203 (the first regulating unit) of the document tray 200 and the near side regulating plate 402 and the back side regulating plate 403 (the second regulating unit) of the mixed stacking tray 400 be overlapped.

By this, it becomes possible to keep a height of the device lower than in a configuration in which the near side regulating plate 402 and the back side regulating plate 403 of the mixed stacking tray 400 are disposed above the near side regulating plate 202 and the back side regulating plate 203 of the document tray 200. In other words, it becomes possible to keep a distance in the document stacking direction from the second stacking portion 401 of the mixed stacking tray 400 to the first stacking portion 200*a* of the document tray 200 small Incidentally, it is sufficient that at least a part of the near side regulating plate 402 and the back side regulating plate 403 is overlapped with the near side regulating plate 202 and the back side regulating plate 203 as viewed in the sheet widthwise direction Dw. By this, it becomes possible to feed a document 401P stacked on the second stacking portion 401 of the mixed stacking tray 400 and a document 200P stacked on the first stacking portion 200A of the document tray 200 with the same feeding roller 300.

As explained above, in the present Embodiment, it is configured that the near side regulating plate 402 and the back side regulating plate 403 of the mixed stacking tray 400 is capable of moving in the sheet widthwise direction Dw with respect to the second stacking portion 401. In other words, in the present Embodiment, in the sheet widthwise direction, the second regulating unit is configured to be capable of moving with respect to the second supporting portion. By this, it becomes possible to suppress an oblique movement of the document stacked on the mixed stacking tray 400. By suppressing the oblique movement of the document, it becomes possible to suppress a possibility of an occurrence of a conveyance defect, a tilting of a read image, etc.

In particular, as in the present Embodiment, in a configuration in which documents can be stacked in parallel both on the document tray 200 and on the mixed stacking tray 400, which is provided above the document tray 200, there is a case in which the oblique movement of the document stacked on the mixed stacking tray 400 occurs. For example, as a part of the document stacked on the mixed stacking tray 400 (an area of a broken line circle in FIG. 11) is floating without contacting the mixed stacking tray 400, it is difficult to stabilize a posture of the document, and there is a possibility that the document is tilted by a light touch of a user's finger. In addition, for example, in a case in which the document (small size document) is stacked on the mixed stacking tray 400 and then the document (large size document) is stacked on the document tray 200, there is a possibility that the small size document is pushed and tilted by the large size document.

Thus, for example, in a configuration in which side ends of the document are regulated by regulating plates (guide portions) fixed to the second stacking portion 401, upon feeding the document having a smaller width than a distance between the regulating plates (guide portions), there is a possibility that the document moves obliquely. In contrast, in the mixed stacking tray 400 of the present Embodiment, since the near side regulating plate 402 and the back side regulating plate 403, which are capable of moving in the sheet widthwise direction Dw, are provided, it becomes possible to suppress the oblique movement of the document even in a case in which a width of the document stacked on the mixed stacking tray 400 is small.

Modified Examples

The mixed stacking tray 400 of the Embodiment 1 is assumed to be mounted to the ADF 102 before a beginning of a use by the user (upon a shipment from a factory or upon an installation to a user's environment for use). In addition, the mixed stacking tray 400 may be configured to be capable of moving to a use position or to a retracted position with respect to the ADF 102, and to be moved to the retracted position when the mixed stacking tray 400 is not in use. The retracted position is, for example, a position in which the mixed stacking tray 400 is retracted so that the mixed stacking tray 400 is not overlapped with the document tray 200 as viewed from above.

Embodiment 2

Embodiment 2 will be described below. The ADF of the present Embodiment uses a mixed stacking tray 400B provided with a third stacking portion 409 in addition to the second stacking portion 401, instead of the mixed stacking tray 400 of the Embodiment 1. Hereinafter, elements with common reference numerals with the Embodiment 1 should include, unless otherwise stated, substantially the same configurations and actions as those described in the Embodiment 1, and different portions from the Embodiment 1 will be described mainly.

Figure 12:
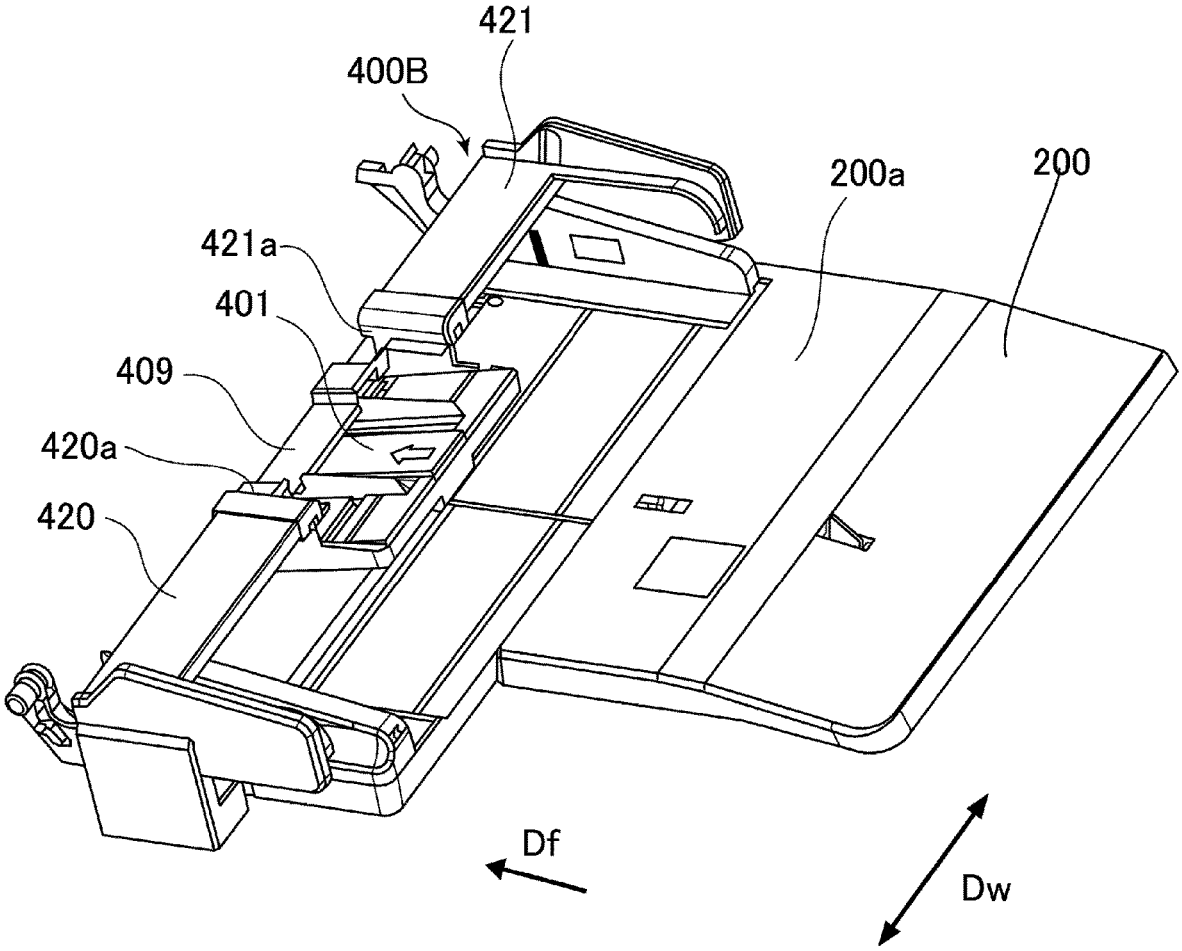
FIG. 12 is a perspective view of a document tray and a mixed stacking tray according to an Embodiment 2.
Figure 13:
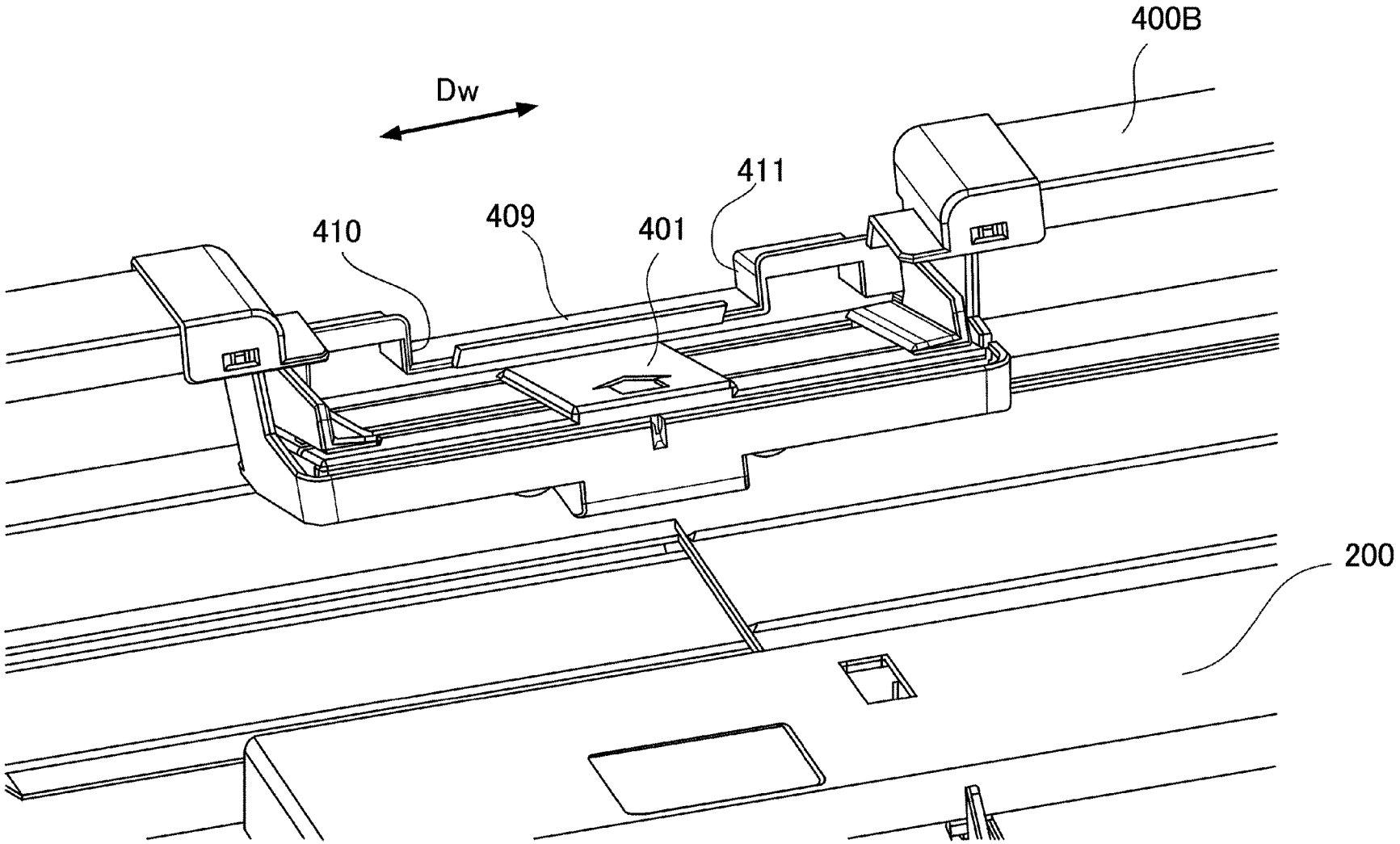
FIG. 13 is a perspective view illustrating a part of the document tray and the mixed stacking tray according to the Embodiment 2.
Figure 14:
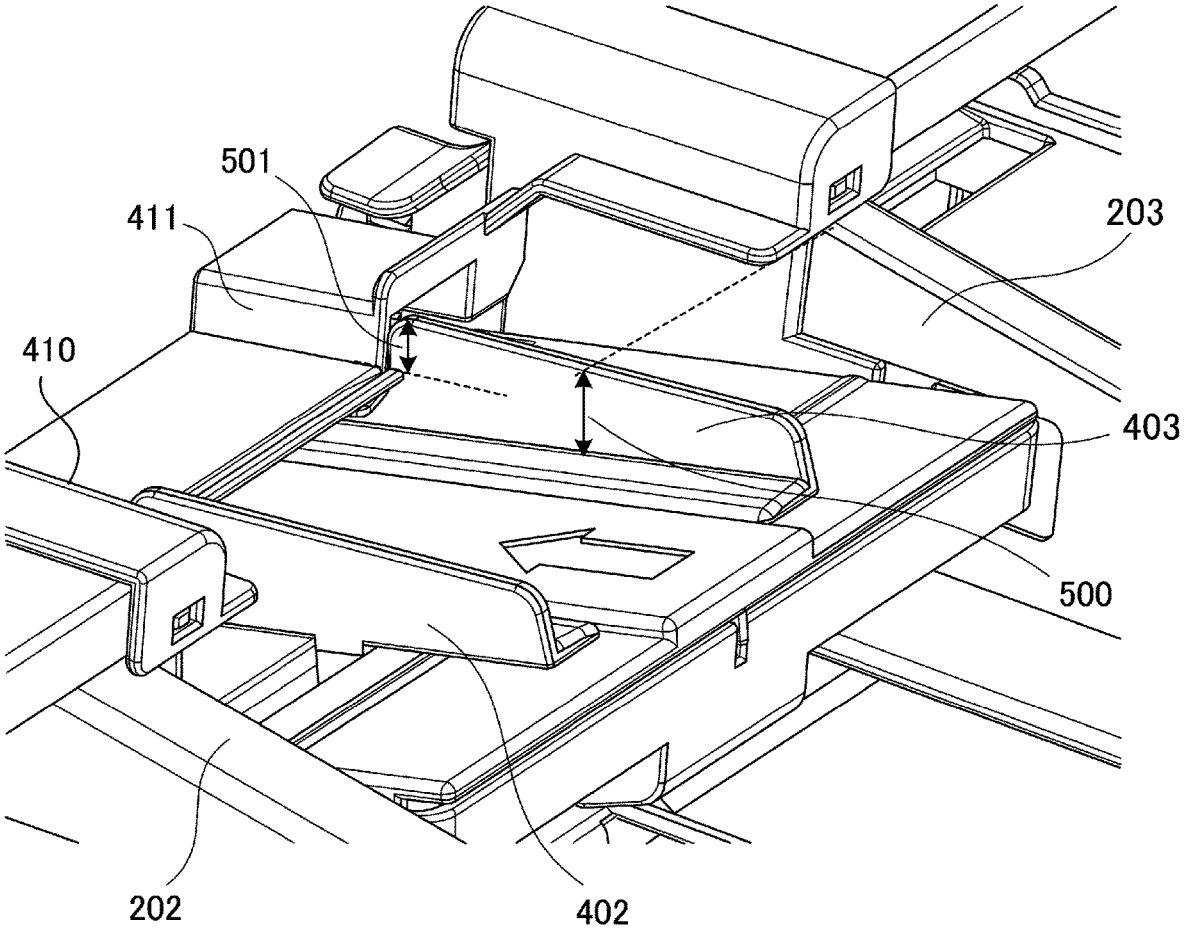
FIG. 14 is a perspective view illustrating a part of the document tray and the mixed stacking tray according to the Embodiment 2.
Figure 15:
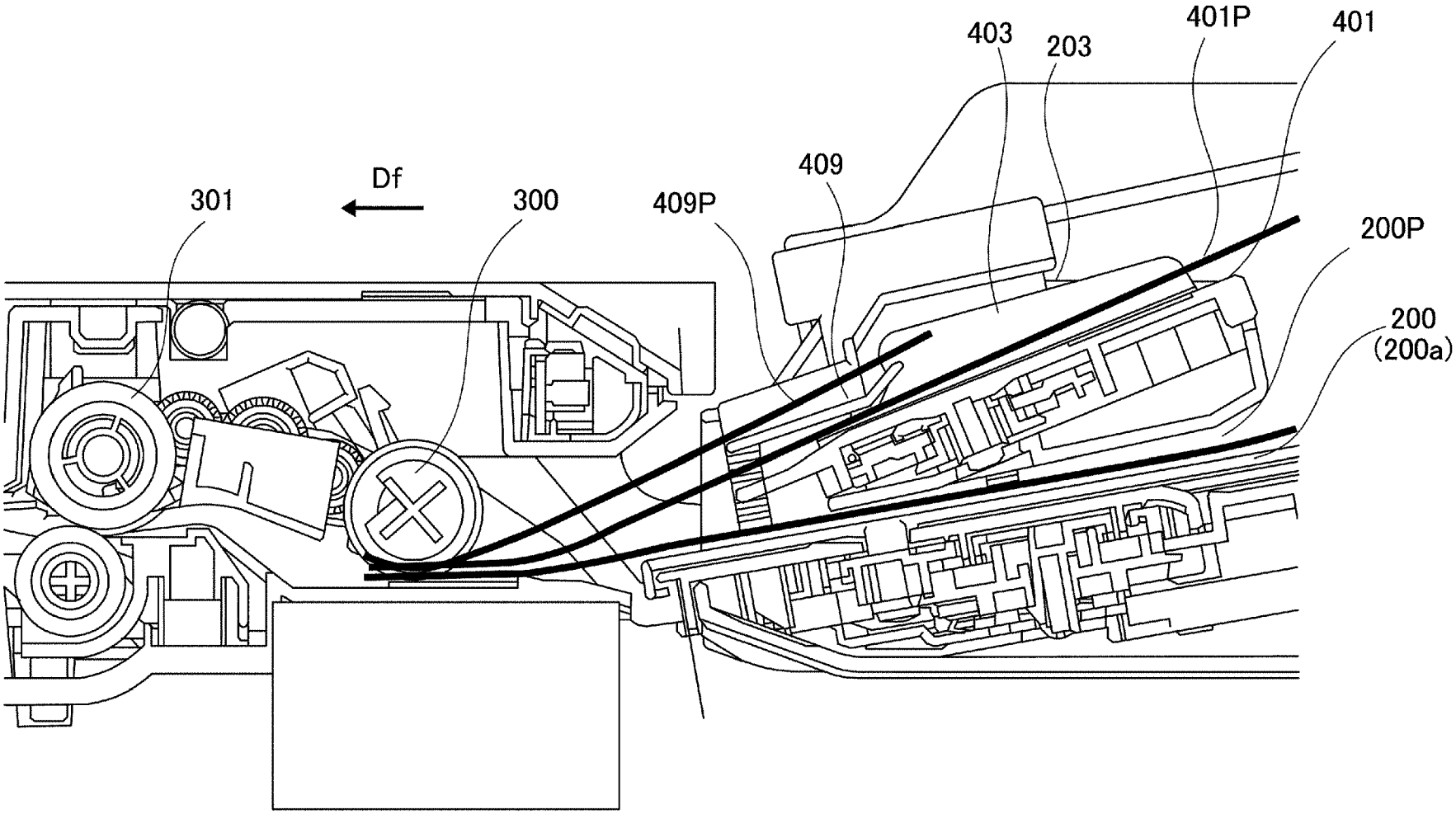
FIG. 15 is a cross-sectional view of an ADF according to the Embodiment 2.

FIG. 12 is a perspective view illustrating the document tray 200 and the mixed stacking tray 400B of the ADF according to the present Embodiment. FIG. 13 is a perspective view illustrating the mixed stacking tray 400B mounted to the ADF. FIG. 14 is a perspective view for describing a positional relationship between the mixed stacking tray 400B and the document tray 200. FIG. 15 is a cross-sectional view of the ADF in a state in which documents are stacked on each of the first stacking portion 200*a* of the document tray 200 and the second stacking portion 401 and the third stacking portion 409 of the mixed stacking tray 400B.

As shown in FIGS. 12 and 13, the mixed stacking tray 400B of the present Embodiment includes the third stacking portion 409 provided above the second stacking portion 401. The third stacking portion 409 is constituted by a component, above the second stacking portion 401, which bridges so as to connect the first portion 420*a* of the arm portion 420 and the first portion 421*a* of the arm portion 421 in the sheet widthwise direction Dw. The third stacking portion 409 is an example of a third supporting portion which is provided above the second supporting portion, and which is capable of supporting a sheet of which a length is shorter than that of the sheet supported by the second supporting portion in the sheet widthwise direction.

In both end portions of the third stacking portion 409 in the sheet widthwise direction Dw, a near side regulating plate 410 and a back side regulating plate 411 are provided. The near side regulating plate 410 and the back side regulating plate 411 are wall surfaces which are protruded above with respect to the third stacking portion 409 and extend in the sheet feeding direction Df, respectively. The near side regulating plate 410 and the back side regulating plate 411 of the present Embodiment are fixed to the third stacking portion 409. The near side regulating plate 410 and the back side regulating plate 411 are examples of a third regulating unit configured to regulate a position of the sheet, supported by the third supporting portion, with respect to the sheet widthwise direction. In addition, the near side regulating plate 410 and the back side regulating plate 411 of the present Embodiment are integrally molded with the third stacking portion 409.

In the present Embodiment, by mounting the mixed stacking tray 400B provided with the third stacking portion 409, three kinds of documents having different sizes can be set in parallel to the ADF 102. In other words, as shown in FIG. 15, a document of a first size 200P can be placed on the first stacking portion 200A of the document tray 200, a document of a second size 401P can be stacked on the second stacking portion 401 of the mixed stacking tray 400B, and a document of a third size 409P can be stacked on the third stacking portion 409 of the mixed stacking tray 400B. The document of the second size 401P is shorter in length with respect to the sheet widthwise direction Dw than the document of the first size 200P, and the document of the third size 409P is even shorter in length with respect to the sheet widthwise direction Dw than the document of the second size 401P. In addition, the ADF of the present Embodiment can execute a feeding operation (mixed-stacking job) in which these three types of documents 200P, 401P and 409P are fed in order by the same feeding roller 300.

As shown in FIG. 14, it is preferable that, in a document stacking direction, positions of the near side regulating plate 402 and the back side regulating plate 403 of the mixed stacking tray 400B and positions of the near side regulating plate 202 and the back side regulating plate 203 of the document tray 200 be overlapped in a part of the range 500. The document stacking direction is a direction perpendicular to an upper surface of the second stacking portion 401. In addition, in the document placing direction, it is preferable that the positions of the near side regulating plate 402 and the back side regulating plate 403 of the mixed stacking tray 400B and positions of the near side regulating plate 410 and the back side regulating plate 411 of the third stacking portion 409 are overlapped in a part of a range 501.

By this, it becomes possible to keep a distance in the document stacking direction from the first stacking portion 200*a* to the third stacking portion 409 small, even though the configuration is provided with three levels of document stacking portions (200*a*, 401, 409). Incidentally, it is sufficient that at least a part of the near side regulating plate 410 and the back side regulating plate 411 is overlapped with the near side regulating plate 402 and the back side regulating plate 403 as viewed in the sheet widthwise direction Dw. By this, it becomes possible to feed the document 200P, the document 401P, and the document 409P stacked on the first stacking portion 200A of the document tray 200, the second stacking portion 401 of the mixed stacking tray 400B, and the third stacking portion 409 of the mixed stacking tray 400B, respectively, with the same feeding roller 300.

OTHER EMBODIMENTS

In each of the Embodiments described above, the ADF 102 of the image reading device 101 mounted to an upper portion of the image forming apparatus main assembly is described as an example of the sheet feeding device. The sheet feeding device is not limited to this, but may be, for example, a sheet feeding apparatus (manual feed unit) which feeds the sheets as the recording material from a manual feed tray which is provided to be openable and closable at a side surface portion of the image forming apparatus main assembly. In addition, the sheet feeding device may also be a sheet feeding device which feeds the sheet as a document in an image reader which is independent of the image forming apparatus main assembly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-188140 filed on Nov. 25, 2022, which is hereby incorporated by reference herein in its entirety.

What is claimed is:

1. A sheet feeding device comprising:

a first supporting portion configured to support a sheet;

a first regulating unit movably provided to the first supporting portion with respect to a sheet widthwise direction perpendicular to a sheet feeding direction and configured to regulate a position of the sheet, supported by the first supporting portion, with respect to the sheet widthwise direction;

a second supporting portion provided above the first supporting portion and configured to be capable of supporting a sheet, of which a length in the sheet widthwise direction is shorter than that of the sheet supported by the first supporting portion, in a state in which the first supporting portion supports the sheet;

a second regulating unit movably provided to the second supporting portion with respect to the sheet widthwise direction and configured to regulate a position of the sheet, supported by the second supporting portion, with respect to the sheet widthwise direction;

an arm portion supported by the first supporting portion and configured to hold the second supporting portion at an upper position of the first supporting portion; and a feeding member configured to feed the sheet supported by the first supporting portion and the sheet supported by the second supporting portion with respect to the sheet feeding direction, wherein as viewed in the sheet widthwise direction, the second regulating unit is disposed so that at least a part of the second regulating unit is overlapped with the first regulating unit, wherein the arm portion includes (1) a first portion connecting to an end portion of the second supporting portion with respect to the sheet widthwise direction and extending toward an upper side from the end portion of the second supporting portion and (2) a second portion extending toward the outside in the sheet widthwise direction from an upper end of the first portion, and wherein the first regulating unit moves below the arm portion and is capable of moving toward an inside in the sheet widthwise direction to a position abutting to the first portion.

2. A sheet feeding device according to claim 1, wherein the second regulating unit includes a pair of second regulating members opposed in the sheet widthwise direction, and wherein the pair of second regulating members move in interrelation with each other in opposite directions with respect to the sheet widthwise direction.

3. A sheet feeding device according to claim 2, wherein the first regulating unit includes a pair of first regulating members opposed in the sheet widthwise direction, and wherein the pair of first regulating members move in interrelation with each other in opposite directions with respect to the sheet widthwise direction.

4. A sheet feeding device according to claim 2, further comprising:

rack portions provided in the pair of second regulating member, respectively; and a pinion gear configured to be interrelated with the pair of second regulating members by engaging with the rack portions, respectively.

5. A sheet feeding device according to claim 1, wherein the sheet feeding device is capable of executing an operation for consecutively feeding (1) the sheet supported by the first supporting portion and (2) the sheet supported by the second supporting portion.

6. A sheet feeding device according to claim 1, further comprising a third portion extending toward a lower side from an outer end portion of the second supporting portion in the sheet widthwise direction, wherein the third portion includes an engaging portion configured to hold the second supporting portion via the arm portion by engaging with an engaged portion fixed to the first supporting portion, and wherein the first regulating unit is capable of moving between the first portion and the third portion of the arm portion in the sheet widthwise direction.

7. A sheet feeding device according to claim 1, further comprising a third supporting portion configured to be capable of supporting a sheet of which a length is shorter than that of the sheet supported by the second supporting portion in the sheet widthwise direction.

8. A sheet feeding device according to claim 7, further comprising a third regulating unit configured to regulate a position of the sheet, supported by the third supporting portion, with respect to the sheet widthwise direction.

9. A sheet feeding device according to claim 1, wherein the second supporting portion is mountable to and demountable from the sheet feeding device.

10. An image reading device comprising:

a sheet feeding device according to claim 1; and a reading portion configured to read image information from the sheet fed by the sheet feeding device.

11. An image forming apparatus comprising:

the image reading device according to claim 10; and an image forming unit configured to form an image on a recording material based on the image information read by the reading portion of the image reading device.

* * * * *